US008544902B2

(12) United States Patent
Remark et al.

(10) Patent No.: US 8,544,902 B2
(45) Date of Patent: Oct. 1, 2013

(54) TAMPER INDICATING ENGAGEMENT LOCK FOR A CONTAINER

(75) Inventors: Preben M. Remark, Hørsholm (DK); Jens C. Velschou, Lyngby (DK)

(73) Assignee: Minna APS, Kokkedal (DK)

( * ) Notice: Subject to any disclaimer, the term of this patent is extended or adjusted under 35 U.S.C. 154(b) by 1022 days.

(21) Appl. No.: 12/306,796

(22) PCT Filed: Jul. 2, 2007

(86) PCT No.: PCT/DK2007/000325

§ 371 (c)(1), (2), (4) Date: Jul. 14, 2009

(87) PCT Pub. No.: WO2008/000270

PCT Pub. Date: Jan. 3, 2008

(65) Prior Publication Data

US 2009/0267362 A1 Oct. 29, 2009

Related U.S. Application Data

(60) Provisional application No. 60/806,586, filed on Jul. 5, 2006.

(30) Foreign Application Priority Data

Jun. 30, 2006 (EP) ..... 06388047

(51) Int. Cl.
*G09F 3/03* (2006.01)

(52) U.S. Cl.
USPC ..... 292/319; 292/307 R

(58) Field of Classification Search
USPC ..... 292/307, 307 R, 319, 318, 321–322, 292/307 A
See application file for complete search history.

(56) References Cited

U.S. PATENT DOCUMENTS

| | | | | |
|---|---|---|---|---|
| 3,980,337 | A | 9/1976 | Moberg et al. | |
| 4,075,742 | A | 2/1978 | Remark et al. | |
| 4,614,373 | A * | 9/1986 | Niemeijer | 292/318 |
| 4,946,210 | A * | 8/1990 | Fuehrer | 292/318 |
| 4,991,889 | A | 2/1991 | Remark | |
| 5,056,837 | A * | 10/1991 | Fuehrer | 292/307 R |
| 5,306,054 | A * | 4/1994 | Georgopoulos | 292/307 R |
| 6,481,765 | B1 * | 11/2002 | Jelavic | 292/307 R |
| 6,540,273 | B2 * | 4/2003 | Brammall et al. | 292/315 |
| 7,172,225 | B2 * | 2/2007 | Foigel et al. | 292/315 |
| 7,438,334 | B2 * | 10/2008 | Terry et al. | 292/327 |
| 2005/0231365 | A1 * | 10/2005 | Tester et al. | 340/568.1 |
| 2006/0261607 | A1 * | 11/2006 | Kromkowski et al. | 292/315 |
| 2007/0201965 | A1 * | 8/2007 | Littlewood | 411/46 |

FOREIGN PATENT DOCUMENTS

| | | |
|---|---|---|
| EP | 0044305 | 7/1986 |
| WO | WO 02/05613 | 1/2002 |

* cited by examiner

*Primary Examiner* — Kristina Fulton
(74) *Attorney, Agent, or Firm* — Klein, O'Neill & Singh, LLP

(57) ABSTRACT

A lock includes first and second mating members. The first member is an elongate member with a first and second ends. The first end has a first transverse dimension and is provided with a plurality of first anti-rotational elements. The second end defines a head with a second transverse dimension greater than the first transverse dimension. The second member has a cavity configured to receive the first end of the first member. The cavity is provided with a plurality of second anti-rotational elements that engage and lock with the first anti-rotational elements when the first end of the first member is inserted into the cavity.

15 Claims, 4 Drawing Sheets

TAMPER INDICATING ENGAGEMENT LOCK FOR A CONTAINER

CROSS-REFERENCE TO RELATED APPLICATION

This application is a national phase filing, under 35 U.S.C. 517 371 (c), of International Application No. PCT/DK2007/000325, filed Jul. 2, 2007, the disclosure of which is incorporated herein by reference in its entirety. This application claims the benefit, under 35 U.S.C. §119(e), of U.S. Provisional Application No. 60/806,586, filed Jul. 5, 2006, the disclosure of which is incorporated herein by reference in its entirety.

FEDERALLY SPONSORED RESEARCH OR DEVELOPMENT

Not Applicable

BACKGROUND OF THE INVENTION

The invention relates to an engagement lock for a container having a pair of locking rings or locking eyelets, said engagement lock comprising first and second members adapted for snap-fit interlocking after the first member has been introduced into a cavity provided in the second member.

An engagement lock of the type indicated above is known from U.S. Pat. No. 3,980,337.

The elongated body of such a prior art lock is a cable or wire which is too flexible, and consequently, this flexible member will yield and be bent if e.g. the stroke of a hammer is used in order to try to insert and interlock it with the other member. Moreover, the individual strands of the wire will be untwisted or loosened during such an attempt of interlocking.

An engagement lock is also disclosed in the Danish patent 134 811 corresponding to the U.S. Pat. No. 4,075,742. In this lock the rod-shaped body is a rigid solid rod of metal, and the resistance to its introduction into the cavity during the interlocking can e.g. be overcome in the above mentioned manner by the stroke from a hammer. This lock is opened by cutting the rod-shaped body by means of a strong pair of scissors or shears.

Moreover, an engagement lock is known from the European patent EP 0 044 305 B1 corresponding to U.S. Pat. No. 4,991,889, from which the present invention is a further development. Reference is made to the above patents and the above US patents are hereby incorporated in the present specification by reference.

It has turned out to be possible for an unauthorized, person to open the engagement lock by drilling until the rod-shaped body breaks since the cavity is not strong enough to withstand it.

According to the authorized, opening of the engagement lock known in the art, the engagement lock is opened by cutting the rod-shaped body by means of a strong pair of scissors or shears, e.g., by cutting in one of the annular grooves which are intentional lines of weakness.

A thief or a person having fraudulent thoughts, e.g., of transporting non legal goods in a container will not use the authorized opening referred to above, since this person does not want the opening and the subsequent closing of the container and the opening and the subsequent closing of the engagement lock to be revealed later on during inspection of the engagement lock. A thief or a fraudulent person attempting to transport non legal goods, e.g., drugs, etc in the container will attempt to break the engagement lock and store his "goods" in the container prior to—if at all possible—locking the container again. This person does not want addition or replacement of goods to be revealed later on by inspecting the engagement lock, e.g. by visible crack or other hammering or drilling traces.

It is, of course, possible to open the container lock by cutting the rod-shaped body by means of e.g. a strong pair of scissors and/or shears but this will be visible from the outside the container, e.g. visible for customs officers or other persons handling the container.

SUMMARY OF THE INVENTION

An object of the present invention is to provide an engagement lock which cannot be broken by a hammer or by drilling in an unauthorized manner, and which engagement lock can only be opened by the intentional authorized opening.

A feature of the present invention relates to the fact that the provision of the blocking for any unauthorized opening of the lock is provided concealed in the lock itself thereby preventing any unauthorized tampering with the blocking which else could allow a thief or a fraudulent person to successfully convert the lock according to the present invention into a lock of the prior art which does not prevent unauthorized breaking or opening.

The above object, and the above feature, together with other objects, features and advantages which will be evident from the below detailed description of presently preferred embodiments of the engagement lock according to the present invention, are according to the teachings of the present invention obtained by two alternative aspects, wherein the term "transversal dimension" is understood to mean "diameter".

The first aspect relates to an engagement lock for a container having a pair of locking rings, the engagement lock comprising:

a first member comprising a rod-shaped elongate body defining a first and a second end, and defining an axis in the longitudinal direction of the rod-shaped elongate body, the first end constituting an insertion end defining a surface and a first transversal dimension, and the second end comprising a head defining a second transversal dimension, the second transversal dimension being larger than the first transversal dimension of the insertion end;

a second member having a cavity defining a third transversal dimension allowing the insertion end to snap-fit interlock with the second member provided the insertion end of the first member is introduced into the cavity, the second member defining an outer, fourth transversal dimension;

the second transversal dimension of the head of the first member, and the outer, fourth transversal dimension of the second member being larger than the apertures of the locking rings, and the first transversal dimension of the insertion end being smaller than the apertures of the locking rings;

characterized by:

the insertion end being provided on the surface with a first number of protruding locking elements extending in the direction of the axis;

the cavity of the second member being provided with a second number of locking recesses for matingly locking and arresting the insertion end to the cavity whereby the first member being locked and arrested to the second member; and the second number being equal to or greater than the first number.

The second aspect relates to an engagement lock for a container having a pair of locking rings, the engagement lock comprising:

a first member comprising a rod-shaped elongate body defining a first and a second end, and defining an axis in the longitudinal direction of the rod-shaped elongate body, the first end constituting an insertion end defining a surface and a first transversal dimension, and the second end comprising a head defining a second transversal dimension, the second transversal dimension being larger than the first transversal dimension of the insertion end;

a second member having a cavity defining a third transversal dimension allowing the insertion end to snap-fit interlock with the second member provided the insertion end of the first member being introduced into the cavity, the second member defining an outer, fourth transversal dimension;

the second transversal dimension of the head of the first member, and the outer, fourth transversal dimension of the second member being larger than the apertures of the locking rings, and the first transversal dimension of the insertion end being smaller than the apertures of the locking rings;

characterized by:

the insertion end being provided on the surface with a first number of locking recesses extending in the direction of the axis;

the cavity of the second member being provided with a second number of protruding locking elements for matingly locking and arresting the insertion end to the cavity whereby the first member being locked and arrested to the second member; and the first number being equal to or greater than the second number.

The provision of the set of protruding locking elements and locking recesses prevents the engagement lock from being broken without authorization or opened by means of a hammer or by drilling or rotating, and further the presence of the co-operating and mating locking elements and locking recesses concealed within the second member prevents the engagement lock from being converted by tampering from an unauthorized opening non-blocking engagement lock into an unauthorized opening blocking engagement lock which may in some cases be successfully opened by unauthorized breaking or opening the engagement lock by drilling.

Consequently, the thief or the fraudulent person may try to break open the engagement lock where it cannot be seen, e.g. by drilling or hammering it apart, but according to the present invention using the protruding locking element on the one member and locking recesses on the other member (or vice versa) renders it impossible to break open the engagement lock by drilling or hammering. Accordingly, the present invention provides that the engagement lock cannot be broken in a position of the engagement lock, which is concealed by the locking ring of the container.

According to the presently preferred embodiment of the engagement lock according to the above first or second aspect of the present invention, the first number is preferably 1-9, such as 2-6, and most preferably 4, and the first and the second numbers are identical. Furthermore, according to the presently preferred embodiment of the engagement lock according to the first and the second aspect of the present invention, the protruding locking elements are preferably equidistantly spaced, allowing the engagement lock to be closed and locked in more than a single mutual orientation between the first and the second members of the engagement lock.

For allowing the engagement lock to be easily opened according to the intentional and authorised opening, the first member is preferably provided between its first and second end with a third number of annular grooves perpendicular to the axis of the first member for providing lines of weakness.

In order to be able to track goods in the container, which e.g. travels by ship for several months, it is of the utmost importance that the engagement lock is uniquely coded for later identification.

According to the present invention the engagement lock is provided with an identification element rendering it possible later on to detect if the engagement lock has been switched to another engagement lock. For example, prior to shipping or after filling the container it is written down which engagement lock the container is supplied with.

The identification element of the engagement lock may comprise any coding in visible or readable or invisible or unreadable form, e.g., a code which may be read in day light, or alternatively only when exposed to, e.g., UV-light. The identification element may comprise letters and/or integers, or alternatively comprise color identification comprising one or more colors or alternatively series of digits in combination with or constituting a unique code.

Alternatively, the identification element may comprise a RFID tag defining a unique code, or alternatively include a bar code defining a unique code.

The information contained or included in the identification element in visible or readable form or alternatively in invisible or unreadable form, preferably defines the identity of the manufacturer, a shipping agent, a handling agent or a carrier for identifying the container itself or any combination of the above information.

The identification element is preferably provided so as to be destroyed or be deteriorated provided an attempt is made of unauthorized opening or breaking open the engagement lock, such as hammering or drilling the engagement lock.

The identification element, consequently, is placed at the exterior of the second member and covering the major part of the second member so as to prevent a thief or a fraudulent person who may hold or draft the second member from attempting to open or break the engagement lock without in such an attempt deteriorating or ruining the identification element and thereby revealing that an unauthorized opening has been attempted.

According to alternative embodiments of the engagement lock according to the first and the second aspects of the present invention, the head is a conical head, a disc-shaped head, a spherical shaped head or a pyramid shaped head or a combination of the above geometrical configuration or any other relevant geometrical configuration.

The present invention according to a third aspect of the present invention further relates to a method of locking a container with locking rings comprising the step of providing an engagement lock including anti-rotational elements and preferably implemented in accordance with the above discussed first and second aspect of the present invention such as protruding locking elements and locking recesses.

BRIEF DESCRIPTION OF THE DRAWINGS

The present invention is now to be further described with reference to the drawings, in which.

DETAILED DESCRIPTION OF THE INVENTION

Figure 1:
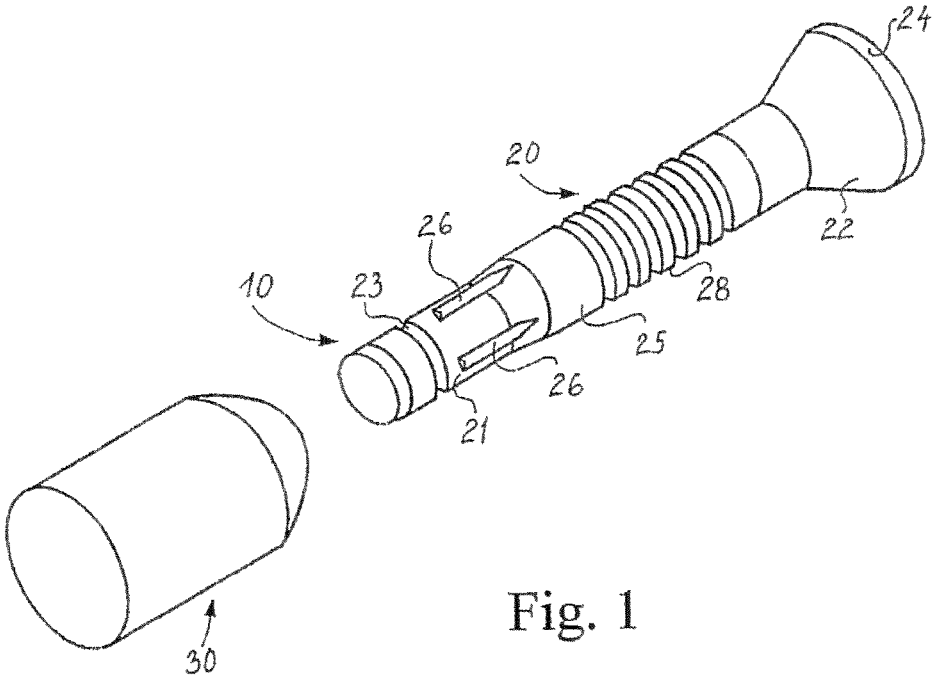
FIG. 1 is a perspective and schematic view of a first and presently preferred embodiment of an engagement lock according to the present invention.

Throughout the figures the same reference numerals indicate identical elements or components. In the present specification, components or elements identical to components or elements, respectively, described previously with reference to a preceding figure are designated the same reference numerals and components or elements differing from previously described components or elements, respectively, however serving the same overall purpose, are designated the same integer as the previously described component or element.

In FIG. 1, a presently preferred embodiment of an engagement lock is shown designated the reference numeral 10. The engagement lock 10 comprises two members 20 and 30 which are adapted to automatic interlocking after the first member 20 which is in the form of a rod-shaped body, has been partly introduced into a cavity of the second member 30. The engagement lock 10 is used for locking a container for the transport of goods. The first member 20 comprises a rod-shaped elongate body which defines a first end 21 and a second end 22. The first end 21 constitutes the insertion end and defines a reduced diameter part as compared to the intermediate part of the first member which intermediate part constitutes a shaft and connects the first end 21 to the second end 22. At the second end 22, a head 24 of considerably longer diameter than the first end 21 and the intermediate part of the first member 20 is provided. The intermediate part or shaft is designated the reference numeral 25 and is provided with circumferentially extending recesses 28 for the purpose of guiding a cutting tool such as a strong scissors or shears which are used for cutting open the engagement lock 10.

At the first end 21 of the first member 20, a circumferential recess 23 is provided which serves the purpose of co-operating with a locking ring of the second member 30 in the locking or arresting of the first member 20 relative to the second member 30 as is known in the art per se.

For preventing turning or rotation of the first member 20 relative to the second member 30 after the first end 21 has been introduced into the above-mentioned cavity of the second member 30 and locked relative to the second member 30 by means of the above-mentioned locking ring, a set of outwardly protruding locking elements or locking ridges 26 is provided. The locking elements or ridges 26 are received in corresponding locking recesses provided at the inner surface of the cavity of the second member 30 as will be described below for preventing the unintentional rotation of the first member 20 relative to the second member 30. The purpose of providing the locking elements or ridges 26 co-operating with corresponding recesses at the inner surface of the cavity of the second member 30 is basically to prevent any unauthorized opening of the engagement lock by a thief or a fraudulent person as it has been realized that some of the prior art engagement locks may be opened without authorization by connecting a drilling machine to the head of the engagement lock and rotating the one member similar to the member 20 of the engagement lock 10 causing the locking between the one member similar to the first member 20 of the engagement lock to be disconnected from its intentional locking to the member corresponding to the member 30.

The presence of the locking element 26 at the first end or insertion end 21 of the first member 20 co-operating with similarly configurated recesses at the surface of the inner cavity of the second member 30 is contemplated to improve the safety and to dramatically reduce the possibility that a thief or a fraudulent person may gain access to a container which is locked by means of the engagement lock 10 by unauthorized opening of the engagement lock 10.

Figure 2:
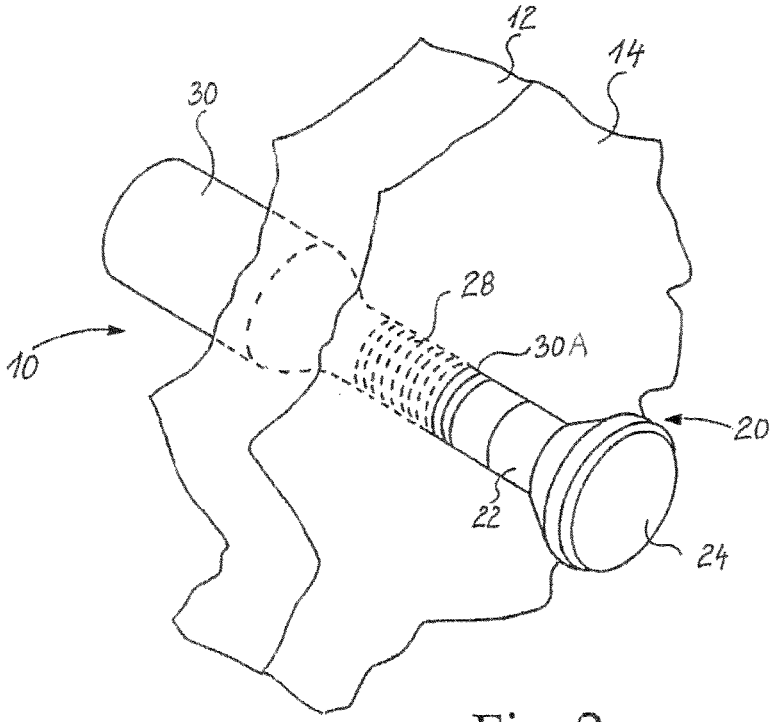
FIG. 2 is a perspective and schematic view of the engagement lock shown in FIG. 1 when used according to its intentional purpose.

In FIG. 2, two plates 12 and 14 constituting two co-operating rings of a closure of a container are located juxtaposed one another and the first member 20 of the engagement lock 10 is introduced through a hole or an aperture 30A of the one plate 14 and further through a similar hole or aperture of the plate 12, and from the opposite side of the assembly of the two plates 12 and 14, the second member 30 is joined with the first member 10 as the first end or insertion end 21 of the first member 10 of the engagement lock is introduced into the inner cavity of the second member 30 and causing the first member 20 to lock the second member 30 of the engagement lock 10.

Figure 3:
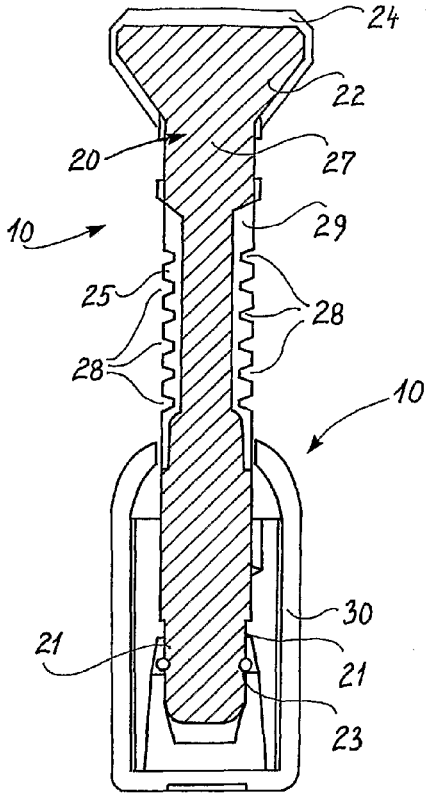
FIG. 3 is a vertical sectional view of the engagement lock shown in FIGS. 1 and 2.

In FIG. 3, the assembly composed of the first member 20 and the second member 30 of the engagement lock 10 is shown in greater details in a vertical sectional view illustrating a metal core 27 of the first member 20 which metal core 27 is covered by a plastics coating of covering 29 which is molded to the metal core 27 and provides the circumferential recesses 28.

Figure 4:
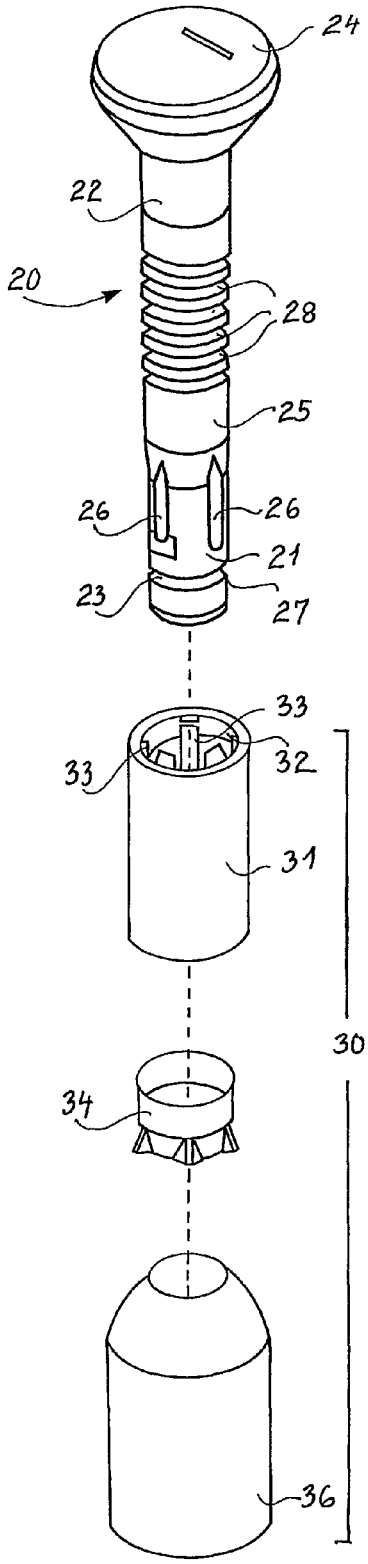
FIG. 4 is a perspective and exploded view of the engagement lock shown in FIGS. 1 and 3.

In FIG. 4, the first member 20 of the engagement lock 10 is shown and the second member 30 of the engagement lock 10 is further shown in exploded view disclosing in greater details the structure of the member.

The second member 30 comprises a metal bushing 31 having an inner surface defining the above described cavity, which surface is designated by the reference numeral 32. In the surface 32, a plurality of recesses 33 are provided serving the purpose of receiving the locking elements or locking ridges 26 of the reduced diameter insertion end 21 of the first member 20 when the first member 20 is locked to the second member 30. The second member 30 further comprises a plug 34 which is received within the metal bushing 31 and which supports, as evident from FIG. 5, the above-mentioned locking ring 35. The second member 30 further comprises, similar to the outer cover 29 of the first member, an outer cover 36.

Figure 5:
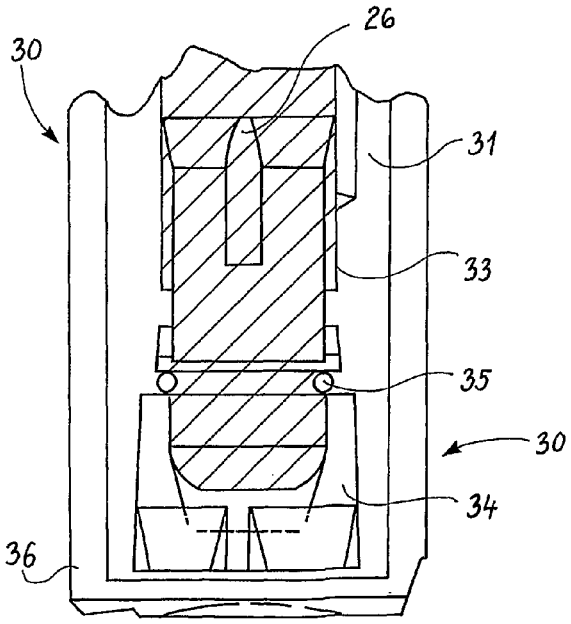
FIG. 5 is a schematic and sectional view of a part of an engagement lock shown in FIGS. 1-4, FIGS. 6, 7 and 8 are perspective, schematic and partly broken away views of alternative embodiments of the engagement lock.

In FIG. 5, a schematic and vertical sectional view of the second member 30 is shown disclosing in greater details the plug 34 and the locking ring 35.

It is to be realized that the above described first and presently preferred embodiment of the engagement lock according to the present invention may be modified in numerous ways, e.g., by shifting the locking elements for the first member 20 to the second member 30, and, in the alternative, by providing locking recesses at the insertion end of the first member 20.

Furthermore, in the above described first and presently preferred embodiment of the engagement lock, a total of four locking elements 26 and similarly a total of four recesses 33 of the metal bushing 31 are provided, however, in an alternative embodiment, e.g. eight or twelve recesses may be provided in the metal bushing 31, allowing the first end 21 of the first member 20 to be inserted into the second member 30 in more than four distinct orientations such as eight or twelve distinct orientations.

Furthermore, the number of co-operating locking elements or ridges and locking recesses of the first and second members 20 or 30 or, alternatively, according to the above described alternative embodiment of the second member and the first member 30 and 20, respectively, may be altered as only a single locking element need to be present for providing the feature characteristic of the present invention of preventing rotation of the first member of the engagement lock relative to the second member of the engagement lock. Further alternatively, any number of co-operating locking elements or locking recesses may be present such as 2-9 sets, e.g. 3, 5, 7, 8 or as discussed above, preferably a total of 4 co-operating locking elements or locking recesses.

Figure 6:
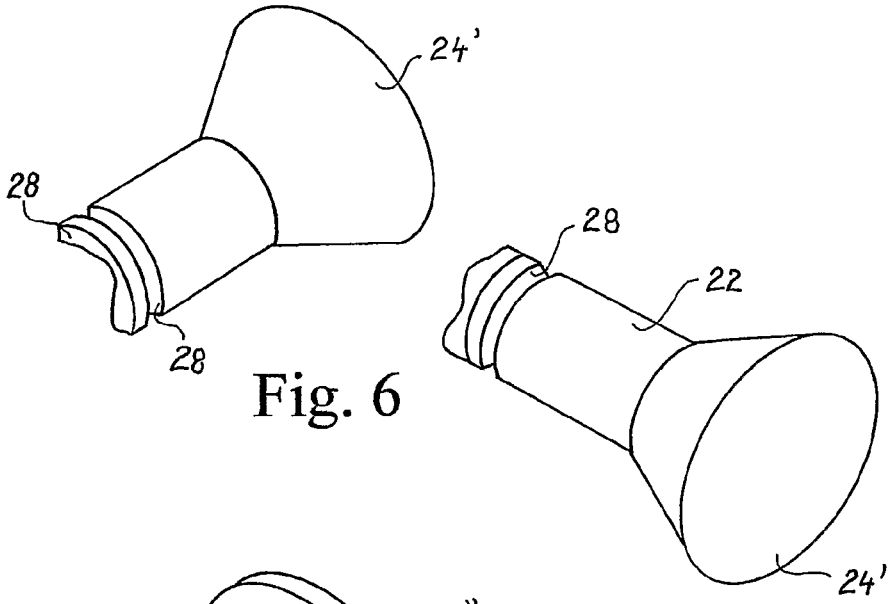
Figure 7:
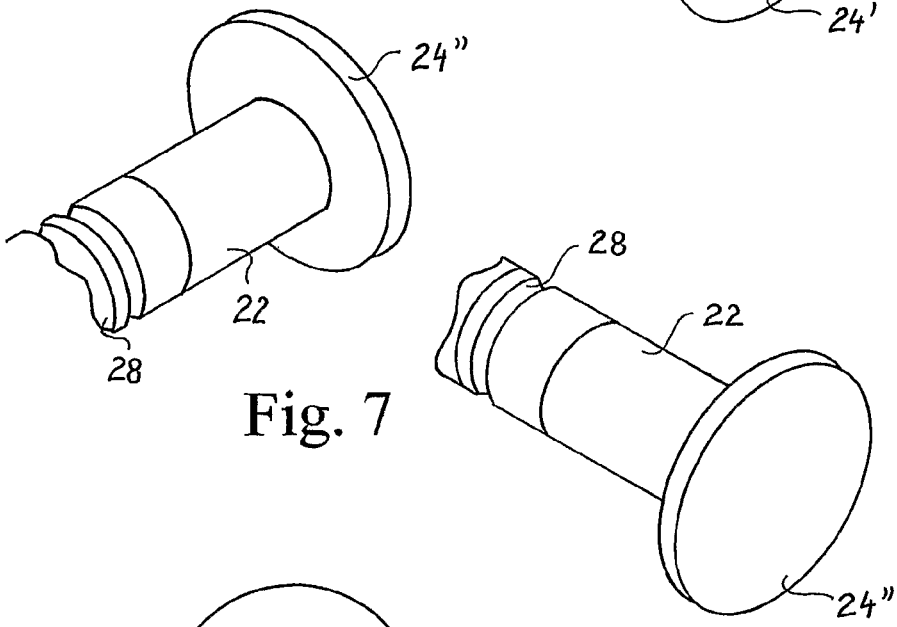
Figure 8:
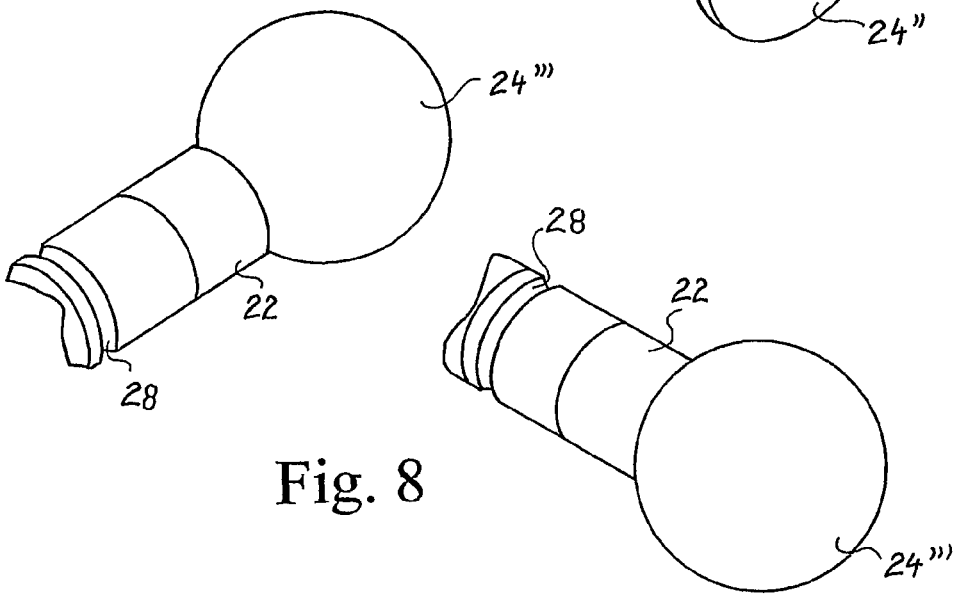

Apart from the number and the location of the co-operating locking elements and locking recesses, the geometry of the structure of the two members 20 or 30 of the engagement lock may be modified, as, for instance, the head 24 of the engagement lock may be differently configured as illustrated in FIGS. 6-8, as in FIG. 6 a variant of the head of the first member of the engagement lock is shown, which head (24') differs from the above described head 24 in that the head 24' has a conical cross-sectional configuration. Alternatively, as is illustrated in FIG. 7, the head 24" may constitute a plain circular cylindrical plate, or further alternatively, as is illustrated in FIG. 8, the head 24'" may constitute a sphere.

Figure 9:
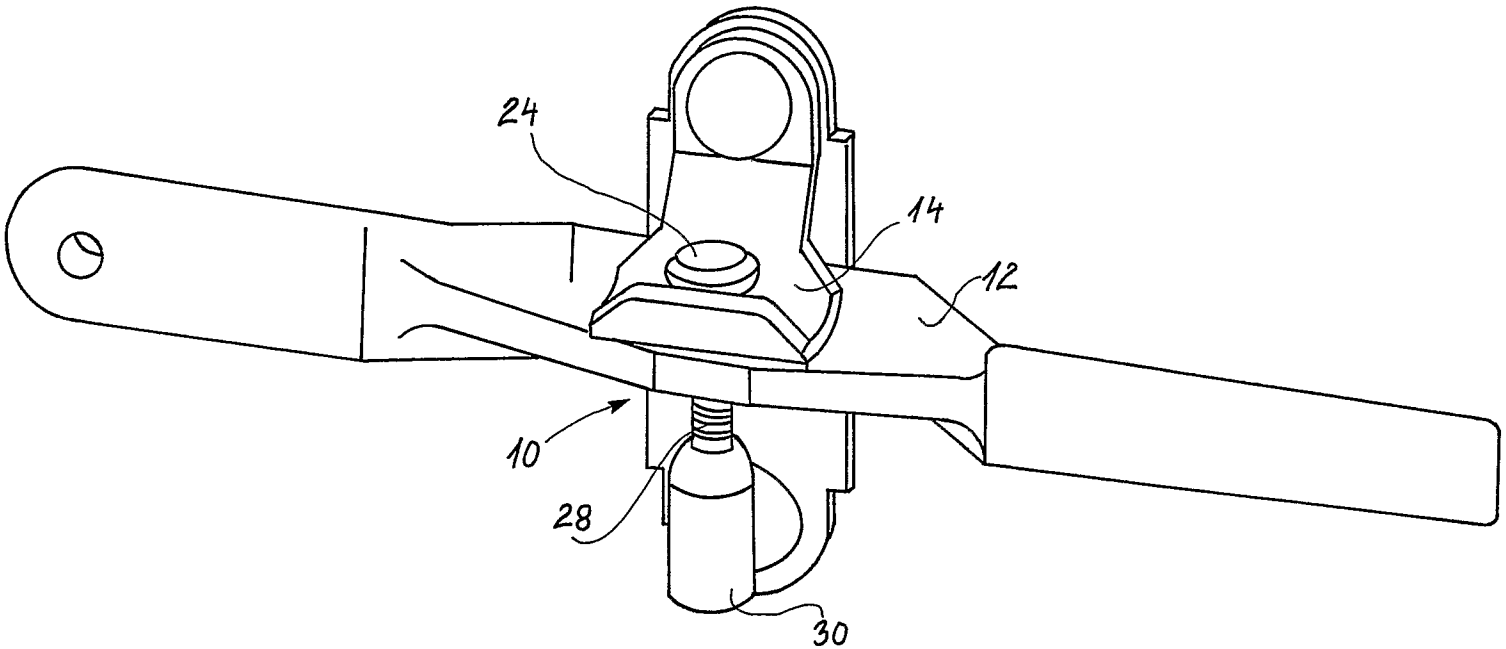
FIG. 9 is a perspective and schematic view of the engagement lock shown in FIGS. 1-5 when used for locking together two parts of a container.

In FIG. 9. the intentional use of the engagement lock 10 is shown as the lock is used for locking the plate 14 constituting a bracket of a container to a plate 12 of the same container for locking and sealing the door of the container, and consequently preventing any unauthorized opening of the door of the container.

Although the above description includes the disclosure of a specific and presently preferred embodiment of the engagement lock according to the present invention, and although specific variants or alternative embodiments are described, numerous additional variants or alternatives may be readily produced by a person having skill in the art, and such variants or embodiments are to be construed part of the present invention as defined in the appending patent claims.

The invention claimed is:

1. An engagement lock for a container having a pair of locking rings, each of the locking rings having an aperture, said engagement lock comprising:

a first member comprising a rod-shaped elongate body defining first and second ends, and defining an axis in the longitudinal direction of said rod-shaped elongate body, said first end constituting an insertion end defining a surface and a first transverse dimension, and said second end comprising a head defining a second transverse dimension larger than said first transverse dimension of said insertion end;

a second member unconnected to said first member and having a cavity defining a third transverse dimension allowing said insertion end to snap-fit interlock with said second member when said insertion end of said first member is introduced through the apertures of said locking rings and into said cavity, said second member defining a fourth transverse dimension;

wherein said second transverse dimension of said head of said first member, and said fourth transverse dimension of said second member are larger than the apertures of said locking rings, and wherein said first transverse dimension of said insertion end is smaller than the apertures of said locking rings;

said insertion end being provided on said surface with a first number of first anti-rotational elements extending longitudinally along said surface; and said cavity of said second member being provided with a second number of second anti-rotational elements configured for engaging and locking with said first anti-rotational elements when said insertion end is inserted into said cavity so as to inhibit rotation of said first member relative to said second member.

2. The engagement lock of claim 1, wherein the first anti-rotational elements are protruding elements and the second anti-rotational elements are recesses.

3. The engagement lock of claim 1, wherein the first anti-rotational elements are recesses and the second locking elements are protruding anti-rotational elements.

4. The engagement lock of claim 1, wherein the first number is no greater than nine.

5. The engagement lock of claim 2, wherein the protruding elements are equidistantly spaced.

6. The engagement lock of claim 1, wherein the first number is equal to the second number.

7. The engagement lock of claim 1, wherein said first member is provided between its said first and second ends with a third number of annular grooves perpendicular to said axis for providing lines of weakness.

8. The engagement lock of claim 1, wherein the second member has an exterior surface that is provided with an identification element.

9. The engagement lock of claim 8, wherein said identification element comprises a color identification element.

10. The engagement lock of claim 8, wherein said identification element comprises a numerical identification code.

11. The engagement lock of claim 8, wherein said identification element comprises an RFID tag defining a unique code.

12. The engagement lock of claim 8, wherein said identification element comprises a bar code.

13. The engagement lock of claim 8, wherein said identification element provides identification information selected from the group consisting of at least one of a manufacturer, a shipping agent, a handling agent, and a carrier.

14. The engagement lock of claim 8, wherein said identification element is configured to be deteriorated in response to an attempted unauthorized opening.

15. The engagement lock of claim 1, wherein said head has a configuration selected from the group consisting of conical, disc-shaped, spherical, and pyramid-shaped.

* * * * *